United States Patent [19]

Menjo et al.

[11] Patent Number: 4,617,258

[45] Date of Patent: Oct. 14, 1986

[54] SILVER HALIDE PHOTOGRAPHIC MATERIAL

[75] Inventors: Hiroshi Menjo, Hachioji; Nobuo Sakamoto, Tsukui; Yoshikazu Watanabe, Akishima, all of Japan

[73] Assignee: Konishiroku Photo Industry Co., Ltd., Tokyo, Japan

[21] Appl. No.: 843,824

[22] Filed: Mar. 25, 1986

Related U.S. Application Data

[63] Continuation of Ser. No. 710,524, Mar. 12, 1985, abandoned, which is a continuation of Ser. No. 480,666, Mar. 31, 1983, abandoned.

[30] Foreign Application Priority Data

Apr. 9, 1982 [JP] Japan ..... 57-59904

[51] Int. Cl.[4] ..... G03C 1/06; G03C 1/34

[52] U.S. Cl. ..... 430/566; 430/608; 430/604; 430/605; 430/440; 430/441; 430/447; 430/448

[58] Field of Search ..... 430/605, 604, 608, 566, 430/440, 441, 447, 448

[56] References Cited

U.S. PATENT DOCUMENTS

| | | | |
|---|---|---|---|
| 2,472,631 | 6/1949 | Stauffer et al. | 430/608 |
| 2,566,245 | 8/1951 | Trivelli et al. | 430/608 |
| 2,566,263 | 8/1951 | Trivelli et al. | 430/608 |
| 2,839,405 | 6/1958 | Jones | 430/608 |
| 3,212,895 | 10/1965 | Barbier et al. | 430/608 |
| 3,312,550 | 4/1967 | Stewart et al. | 430/566 |
| 3,690,892 | 9/1972 | Fairbanks et al. | 430/608 |
| 3,730,716 | 5/1973 | Land et al. | 430/608 |

OTHER PUBLICATIONS

Def. Pub. abstract 867 O.G. 749, published Oct. 21, 1969.

*Primary Examiner*—Won H. Louie

*Attorney, Agent, or Firm*—Jordan B. Bierman

[57] ABSTRACT

A silver halide photographic material is disclosed. It contains per 100 g of silver at least 40 mg of a water-soluble compound comprising an element of group VIII of the periodic table and having a molecular weight of at least 100, and 1.2 to 120 mg of a black-and-white silver halide developing agent. The material has improved gradation characteristics and is subject to minimum variation in photographic characteristics.

12 Claims, No Drawings

SILVER HALIDE PHOTOGRAPHIC MATERIAL

This application is a continuation of application Ser. No. 710,524, filed Mar. 12, 1985, abandoned which is a continuation of application Ser. No. 480,666, filed Mar. 31, 1983, abandoned which claims the priority of Japanese Application No. 59904/1982, filed Apr. 9, 1982.

FIELD OF THE INVENTION

The present invention relates to a silver halide photographic material, and more particularly, to a silver halide photographic material having good gradation characteristics.

BACKGROUND OF THE INVENTION

Silver halide photographic materials must satisfy several requirements. For example, a negative photosensitive film must have a characteristic curve having high compatibility with that of a negative printing paper; namely, the two photographic materials must have good gradation characteristics. The same is true with positive photosensitive materials and they also must have good gradation characteristics to produce the desired tone or color. However, as is well known, the photographic characteristics of commercial silver halide photographic materials are subject to variations during processing on account of the nature of the processing solutions and the operating conditions of the processing machine. The development of a photographic material that is free from this defect has long been desired, but to date no effective method has been devised.

SUMMARY OF THE INVENTION

Therefore, one object of the present invention is to provide a silver halide photographic material having good gradation characteristics.

Another object of the invention is to provide a silver halide photographic material that has improved stability to processing and is subject to minimum variation in the photographic characteristics in spite of varying processing conditions.

These objects of the present invention can be accomplished by a silver halide photographic material which contains at least 40 mg, per 100 g of silver, of a water-soluble compound comprising an element of group VIII of the periodic table and having a molecular weight of at least 100, as well as 1.2 to 120 mg of a black-and-white silver halide developing agent per 100 g of silver.

DETAILED DESCRIPTION OF THE INVENTION

Preferred examples of the water-soluble compound comprizing an element of group VIII of the periodic table and having a molecular weight of at least 100 are salts of metals of periods 5 and 6 such as ruthenium, rhodium, palladium, osmium, iridium and platinum. Typical examples are listed below:

(1) ammonium chloropalladate
(2) potassium chloroplatinate
(3) sodium chloroplatinate
(4) ammonium chloroplatinate
(5) sodium chloropalladite
(6) ammonium hexachloroiridate (IV)
(7) potassium hexachloroiridate (IV)
(8) sodium hexachloroiridate (IV)
(9) ammonium hexachloroosmate (IV)

(10) rhodium trichloride
(11) potassium hexachlororhodate
(12) sodium hexachlororhodate,
(13) diaminopalladium chloride,
(14) sodium hexachloroplatinate (IV).

More preferred examples are salts of rhodium, iridium and platinum. These compounds comprising an element of group VIII are incorporated in the photographic material of the present invention in an amount of at least 40 mg, preferably up to 500 mg, per 100 g of silver. These compounds are desirably added as an aqueous solution to a photographic emulsion in the photographic material of the present invention. The concentration of the aqueous solution may range from 0.01 to 10 wt %. The compounds comprising an element of group VIII may be added to a silver halide emulsion before, during or after chemical ripening. Alternatively, they may be added when silver halide grains are prepared.

Preferred examples of the cation of said salt of metal include an ammonium ion or an alkaline metal or alkaline earth metal ion. Also, preferred examples of the ligand of said salt of metal include a hydroxy group, a cyano, $H_2O$, a halogen atom, a nitro, $SO_3$, ammonia and $C_2O_4$.

The black-and-white silver halide developing agent (hereunder referred to as the black-and-white developing agent means a silver halide reducing compound and is distinguished from color silver halide developing agents such as aromatic amine derivatives that enter into a coupling reaction with a color coupler to form an image dye. Any of the known black-and-white developing agents may be used in the present invention. Typical examples are listed below.

3-Pyrazolidone compounds

(15) 1-phenyl-3-pyrazolidone , (16) 1-p-tolyl-3-pyrazolidone
(17) 5-phenyl-3-pyrazolidone,
(18) 5-methyl-3-pyrazolidone
(19) 1-phenyl-5-methyl-3-pyrazolieone
(20) 1-acetamidophenyl-3-pyrazolidone
(21) 1-phenyl-4,4-dimethyl-3-pyrazolidone
(22) 1-p-tolyl-4,4-dimethyl-3-pyrazolidone
(23) 1-phenyl-4-methyl-3-pyrazolidone
(24) 4-hydroxy-4-methyl-1-phenyl-3-pyrazolidone
(25) 4-hydroxymethyl-4-methyl-1-phenyl-3-pyrazolidone

Hydroxybenzene compounds

(26) hydroquinone
(27) catechol
(28) pyrogallol
(29) N-methyl-p-aminophenol (30) p-$\beta$-hydroxyethylaminophenol
(31) p-$\alpha$-aminoethylaminophenol
(32) N-methyl-N-($\beta$-sulfoamidoethyl)-p-aminophenol Other useful black-and-white developing agents are ascorbic acid and p-hydroxyphenyl glycine. The black-and-white developing agents are incorporated in the photographic material of the present invention in an amount of 1.2 to 120 mg, preferably 11 to 110 mg, per 100 g of silver. The black-and-white developing agents may be added to a silver halide emulsion in the photographic material by any method, but preferably they are added as a solution in solvent like water or alcohol. The concentration of the solution may vary from 0.01 to 10 wt %. The black-and-white developing agents may be added to the photographic emulsion before, during or after chemical ripening.

The compound containing an element of group VIII and the black-and-white developing agent accroding to the present invention exhibit their desired effects if they are incorporated in the silver halide photographic material. If they are to be incorporated in a silver halide color photographic material, the two compounds may be incorporated in photosensitive units of the same color sensitivity. But this is optional and the ratio of the amounts of the respective compounds and the type of photosensitive units in which they are to be incorporated may be suitably determined.

Any known silver halide emulsion may be used in the silver halide photographic material, and suitable examples are silver chloride, silver bromide, silver iodobromide, silver chlorobromide, silver iodochloride and silver chloroiodobromide crystals as well as mixtures thereof. These silver halide emulsions may comprise small or large grains in a mono- or polydisperse system. The silver halide crystals may be cubic, octahedral or epitaxially mixed. The emulsions may be negative or direct positive. They may be of the surface latent image type which forms a latent image on the surface of silver halide grains, or of the internal latent image type which forms a latent image within silver halide grains, or of a mixed type.

The silver halide photographic material of the present invention may contain any photosensitive dye for spectral sensitization and other purposes. Illustrative dyes are cyanine, merocyanine and xanthene dyes of the type described in C. E. K. Mees and T. H. James, "The Theory of the Photographic Process", 3rd Ed., Macmillan N.Y., 1966, pp. 198–228.

Examples of the binder that can be used in the silver halide photographic material of the present invention include gelatin, colloidal albumin, agar, gum arabic, alginic acid; cellulose derivatives such as hydrolyzed cellulose acetate, carboxymethyl cellulose, hydroxyethyl cellulose and methyl cellulose; synthetic binders such as polyvinyl alcohol, partially saponified polyvinyl acetate, polyacrylamide, poly-N,N-dimethylacrylamide, poly-N-vinylpyrrolidone and other water-soluble polymers; gelatin derivatives such as phenylcarbamylated gelatin, acylated gelatin and phthalated gelatin; and copolymers wherein monomers having a polymerizable ethylene group such as acrylic acid (or ester), methacrylic acid (or ester) and acrylonitrile are grafted onto gelatin. If necessary, two or more of these binders may be used in admixture.

Th silver halide emulsion that is used in the silver halide photographic material of the present invention may be sensitized with a chemical sensitizer. Advantageous chemical sensitizers are a noble metal sensitizer, a sulfur sensitizer, a selenium sensitizer and a reduction sensitizer. The silver halide emulsion may contain a stabilizer. Useful stabilizers include nitrogen-containing heterocyclic compounds, quaternary ammonium salts, mercapto compounds, polyhydroxybenzene compounds, thione compounds and tetrazaindene compounds. Illustrative nitrogen-containing heterocyclic compounds are 4-oxo-6-thiono-4,5,6,7-tetra-hydro-1-thia-3,5,7-triazaindene, 2-substituted benzimidazole, benzotriazole, substituted 1,2,3-triazole, urazol, pyrazole, tetrazole compounds and polyvinyl pyrrolidone. Polyvinyl pyrrolidone is particularly useful in the present invention. Illustrative quaternary ammonium salts are thiazolium compounds and pyrilium compounds. Benzothiazolium compounds are particularly useful. Illustrative mercapto compounds are 5-phenyl-1-mercaptotetrazole, 2-mercapto-benzothiazole, 2-mercaptothiazole, mercaptobenzimidazole, mercaptooxadiazole, mercaptothiadiazole, thiosugar and 4-thiouracil. Particularly useful are 5-phenyl-1-mercaptotetrazole and 2-mercaptobenzothiazole. Illustrative polyhydroxybenzene compounds are 1,2-dihydroxybenzene compounds, gallic acid esters (e.g. disoamyl gallate, dodecyl gallate and propyl gallate), and 2-alkyl-hydro-guinone. Illustrative thione compounds are thiazoline-2-thione compounds, as well as zinc and cadmium salts thereof. Illustrative tetrazaindene compounds are 4-hydroxy-6-methyl-1,3,3a,7-tetrazaindene, 4-methyl-6-hydroxy-1,3,3a,7-tetrazaindene, and 4-hydroxy-5,6-dimethyl-1,3,3a,7-tetrazaindene. The above listed stabilizers may be combined with each other to achieve higher stabilizing effects.

The silver halide emulsion may be hardened by ordinary techniques. Common photographic hardeners may be used and they are aldehyde compounds such as formaldehyde, glyoxal and glutaraldehyde, as well as derivative compounds thereof such as acetals and sodium bisulfite adducts; methanesulfonate ester compounds; mucochloric acid or mucohalogenic acid compounds; epoxy compounds; aziridine compounds; active halogen compounds; maleinimide compounds; active vinyl compounds; carbodiimide compounds; isoxazole compounds; N-methylol compounds; isocyanate compounds; and inorganic hardeners such as chrome alum and zirconium sulfate.

The silver halide photographic material of the present invention may contain surfactants individually or in admixture. The photographic material may also contain an antistat, a plasticizer, a brightening agent, a development accelerator, an agent to prevent aerial fogging or a toning agent.

The silver halide photographic material of the present invention may further contain any known dye forming coupler to produce a color image. Preferred couplers are such that they stay within a specific layer and will not diffuse into other layers during production, storage or processing of the silver halide photographic material. Four- or two-equivalent couplers may be used. Colored couplers for color correction, colorless couplers, or DIR couplers that release a development inhibitor during development may also be used. Known open-chain ketomethylene couplers may be used as yellow color couplers. Benzoyl acetanilide and pivaloyl acetanilide compounds are advantageously used. Specific yellow color couplers that can be used in the present invention are described in U.S. Pat. Nos. 2,875,057, 3,408,194, 3,551,155, 3,582,322, and 3,894,875, German Patent Publication No. 1,547,868, and German Patent Applications (OLS) Nos. 2,213,461, 2,261,361, 2,263,875, and 2,414,006. Typical magenta couplers are 5-pyrazolone compounds, and indazolone and cyanoacetyl compounds are also usable. Illustrative magenta couplers are described in U.S. Pat. Nos. 2,600,788, 3,062,653, 3,127,269, 3,311,476, 3,419,391, 3,519,429, 3,558,319, 3,582,322, and 3,615,506, German Pat. No. 1,810,464, German Patent Applications (OLS) Nos. 2,408,665, 2,418,959, and 2,424,467, and Japanese Patent Publications Nos. 6031/65 and 2016/69. Typical cyan couplers are phenol and naphthol derivatives. Specific cyan couplers are described in U.S. Pat. Nos. 2,369,929, 2,474,293, 2,521,908, 2,895,826, 3,034,892, 3,386,830, 3,458,315, 3,476,563, 3,583,971, 3,591,383, and Japanese Patent Application (OPI) No. 78905/73 (the symbol OPI as used herein means an unexamined published Japanese patent application).

The silver halide photographic material of the present invention may also contain a DIR coupler that releases a development inhibitor in color forming reactions or a compound that releases a compound to inhibit development on the same occasion. Specific examples of these compounds are described in U.S. Pat. Nos. 3,227,554, 3,632,345, 3,701,783, 3,790,384, 3,297,445 and 3,379,529, British Pat. No. 953,454, German Patent Applications (OLS) Nos. 2,414,006, 2,417,914, 2,454,301 and 2,454,329, and Japanese Patent Applications (OPI) Nos. 145135/79 and 137353/81. The silver halide photographic material may further contain a colored coupler for color correction. Two or more of the above named couplers may be incorporated in the same layer to satisfy the requirements for the silver halide photographic material, or the same compound may be incorporated in two or more different layers.

The couplers that can be used in the present invention are generally dispersed in a silver halide emulsion layer together with a solvent having a suitable polarity. Useful solvents are tri-o-cresyl phosphate, trihexyl phosphate, dioctylbutyl phosphate, di-butyl phthalate, diethyllaurylamide, 2,4-diallylphenol and octyl benzoate. The silver halide photographic material of the present invention may further contain other photographic addenda.

The concept of the present invention can be applied to such silver halide photographic materials as color and black-and-white positive films, color and black-and-white printing papers, color and black-and-white negative films, color and black-and-white reversal films (which may contain couplers), photographic materials for photomechanical processes (e.g. gravure films), photographic materials for CRT displays, and photographic materials for X-ray recording. These photographic materials can be subjected to transfer process (as described in U.S. Pat. No. 2,716,059), silver salt diffusion transfer process (as described in U.S. Pat. Nos. 2,352,014, 2,543,181, 3.020,155 and 2,861,885), color diffusion transfer process (as described in U.S. Pat. Nos. 3,087,817, 3,185,567, 2,983,606, 3,253,915, 3,227,550, 3,227,551, 3,227,552, 3,415,644, 3,415,645, and 3,415,646), and dye transfer process (as described in U.S. Pat. No. 2,882,156).

The present invention is described by the following examples, but it should be understood that the technical scope of the invention is by no means limited to these examples and various modifications can be made thereto without departing from the spirit and scope of the invention.

EXAMPLE 1

A high-sensitivity silver iodobromide emulsion containing 2 mol % of silver iodide prepared by the double-jet method was subjected to gold sensitization and sulfur sensitization and divided into 15 portions. To the respective portions (each weighing 1 kg and containing 1 mol of silver halide), compounds comprising an element of group VIII and black-and-white developing agents were added as aqueous solutions in the amounts indicated in Table 1 below. Mucochloric acid and saponin were added to the respective samples, which were applied onto cellulose triacetate bases and dried. Two strips of each sample were made and subjected to exposure through an optical wedge. One strip was developed at 30° C. for 2 minutes with a solution of formulation (A), and the other strip was also developed under the same conditions, but this time with a solution of formulation (B). Then, both strips were fixed and washed with water.

| | |
|---|---|
| Developing solution (A) | |
| Monovatol ® | 3.5 g |
| Anhydrous sodium sulfite | 40.0 g |
| Hydroquinone | 7.0 g |
| Sodium carbonate | 30.0 g |
| Patassium bromide | 1.0 g |
| Water to make | 1,000 ml |
| PH adjusted to | 10.2 |
| Developing solution (B) | |
| Same as solution (A) except that the pH was adjusted to 11.0. | |

The characteristic curves of the silver images formed on the respective samples were analyzed to determine their sensitivities, gamma values and fog densities. The sensitivities were determined from the amount of exposure necessary for providing an optical density equal to "fog density +0.1", with the value obtained by processing with control solution (A) taken as 100. The results are shown in Table 1.

TABLE 1

| Sample No. | Compound comprising an element of group VIII and its amount | Black-and-white developing agent and its amount | Development with solution (A) | | | Development with solution (B) | | | Remarks |
|---|---|---|---|---|---|---|---|---|---|
| | | | Sensitivity | Gamma | Fog | Sensitivity | Gamma | Fog | |
| 1 | — | — | 100 | 0.87 | 0.05 | 117 | 0.98 | 0.08 | Control |
| 2 | (1) 50 | (29) 40 | 100 | 0.70 | 0.04 | 102 | 0.71 | 0.04 | Sample of the present invention |
| 3 | (4) 50 | (29) 40 | 101 | 0.68 | 0.04 | 101 | 0.68 | 0.04 | " |
| 4 | (6) 50 | (29) 40 | 102 | 0.67 | 0.04 | 102 | 0.67 | 0.04 | " |
| 5 | (9) 50 | (29) 40 | 100 | 0.70 | 0.04 | 103 | 0.72 | 0.04 | " |
| 6 | (12) 50 | (29) 40 | 101 | 0.68 | 0.04 | 101 | 0.68 | 0.04 | " |
| 7 | (7) 50 | (15) 40 | 98 | 0.69 | 0.04 | 98 | 0.69 | 0.04 | " |
| 8 | (7) 50 | (16) 40 | 102 | 0.66 | 0.04 | 104 | 0.68 | 0.04 | " |
| 9 | (7) 50 | (26) 40 | 98 | 0.65 | 0.04 | 98 | 0.65 | 0.04 | " |
| 10 | (7) 50 | (27) 40 | 100 | 0.71 | 0.04 | 102 | 0.75 | 0.04 | " |
| 11 | (7) 50 | (32) 40 | 97 | 0.69 | 0.04 | 98 | 0.72 | 0.04 | " |
| 12 | (7) 50 | — | 94 | 0.75 | 0.04 | 94 | 0.88 | 0.04 | Comparative sample |
| 13 | — | (29) 40 | 108 | 0.89 | 0.06 | 112 | 1.01 | 0.09 | " |
| 14 | (7) 50 | (29) 150 | 103 | 0.89 | 0.06 | 109 | 0.97 | 0.07 | " |

TABLE 1-continued

| Sample No. | Compound comprising an element of group VIII and its amount | Black-and-white developing agent and its amount | Development with solution (A) Sensitivity | Gamma | Fog | Development with solution (B) Sensitivity | Gamma | Fog | Remarks |
|---|---|---|---|---|---|---|---|---|---|
| 15 | (7) 50 | (29) 40 | 100 | 0.67 | 0.04 | 100 | 0.67 | 0.04 | Sample of the present invention |

N.B.
1. The amounts of the agents added are indicated in milligrams per 100 g of silver.
2. The agents are keyed to the compound numbers listed in the specification.

As Table 1 shows, the samples according to the present invention were subject to much less variation in photographic characteristics than the comparative samples in spite of varying processing conditions.

EXAMPLE 2

A high-sensitivity silver iodobromide emulsion containing 7 mol % of silver iodide prepared by the double-jet method was subjected to gold and sulfur sensitizations and divided into 12 portions. To the respective portions (each weighing 1 kg and containing 1 mol of silver halide), compounds comprising an element of group VIII and black-and-white developing agents were added as aqueous solutions in the amounts indicated in Table 2 below.

Eighty grams of α-pivalyl-4-(4-benzyloxyphenylsulfonyl)phenoxy-2-chloro-5-[γ-(2,4-di-t-amylphenoxy) butylamido]acetanilide was completely dissolved in a mixture of tricresyl phosphate (100 ml) and ethyl acetate (50 ml), and 2 g of sorbitan monolaurate was added to the solution. The resulting solution was added to 1 kg of a 10 wt % aqueous gelatin solution containing 2.5 g of dodecylbenzenesulfonic acid, and the mixture was stirred at high speed and then stirred by ultrasonic waves to prepare an emulsion. The emulsion (400 g) was added to each of the previously prepared emulsions together with a hardener and a spreader. The resulting samples were applied onto cellulose triacetate bases and dried. Two strips of each sample were made and subjected to exposure through an optical wedge. One strip was developed at 37.8° C. for 3 minutes and 15 seconds with a solution of formulation (C), and the other strip was also developed under the same conditions but this time with a solution of formulation (D). Then, both strips were subjected to the following steps of photographic processing.

| | |
|---|---|
| Bleaching | 6 min 30 sec |
| Washing with water | 3 min 15 sec |
| Fixing | 6 min 30 sec |
| Washing with water | 3 min 15 sec |
| Stabilizing | 1 min 30 sec |
| Drying | |

The following solutions were employed in the respective steps:

| | |
|---|---|
| Developing solution (C) | |
| 4-Amino-3-methyl-N—ethyl-N—(β-hydroxyethyl) aniline sulfate salt | 4.8 g |
| Anhydrous sodium sulfite | 0.14 g |
| Hydroxyamine hemisulfate | 1.98 g |
| Sulfuric acid | 0.74 g |
| Anhydrous potassium carbonate | 28.85 g |
| Anhydrous potassium hydrogencarbonate | 3.46 g |
| Anhydrous potassium sulfite | 5.10 g |
| Potassium bromide | 1.16 g |
| Sodium chloride | 0.14 g |
| Nitrilotriacetic acid trisodium salt (monohydrate) | 1.20 g |
| Potassium hydroxide | 1.48 g |
| Water to make | 1,000 ml |
| pH adjusted to | 10.0 |
| Developing solution (D) | |
| Same as solution (C) except that the pH was adjusted to 10.5. | |
| Bleaching solution | |
| Ethylenediaminetetraacetic acid iron ammonium salt | 100.0 g |
| Ethylenediaminetetraacetic acid diammonium salt | 10.0 g |
| Ammonium bromide | 150.0 g |
| Glacial acetic acid | 10.0 ml |
| Water to make | 1,000 ml |
| pH adjusted to 6.0 with ammonia water | |
| Fixing solution | |
| Ammonium thiosulfate | 175.0 g |
| Anhydrous sodium sulfite | 8.6 g |
| Sodium metasulfite | 2.3 g |
| Water to make | 1,000 ml |
| pH adjusted to 6.0 with acetic acid | |
| Stabilizing solution | |
| Formalin | 1.5 ml |
| Konidax (product of Konishiroku Photo Industry Co., Ltd.) | 7.5 ml |
| Water to make | 1,000 ml |

The characteristic curves of the yellow images formed on the respective samples were analyzed to determine their sensitivities, gamma values and fog densities. As in Example 1, the sensitivities were indicated with the value obtained by processing with control solution (C) taken as 100. The results are shown in Table 2.

TABLE 2

| Sample No. | Compound comprising an element of group VIII and its amount | Black-and-white developing agent and its amount | Development with solution (C) Sensitivity | Gamma | Fog | Development with solution (D) Sensitivity | Gamma | Fog | Remarks |
|---|---|---|---|---|---|---|---|---|---|
| 16 | — | — | 100 | 0.78 | 0.06 | 112 | 0.91 | 0.08 | Control |
| 17 | (3) 50 | — | 93 | 0.65 | 0.05 | 93 | 0.75 | 0.06 | Comparative sample |
| 18 | (3) 50 | (15) 30 | 101 | 0.67 | 0.05 | 101 | 0.67 | 0.05 | Sample of the present invention |
| 19 | — | (15) 30 | 110 | 0.80 | 0.06 | 125 | 0.88 | 0.06 | Comparative sample |
| 20 | (8) 30 | (15) 30 | 107 | 0.70 | 0.05 | 107 | 0.78 | 0.05 | " |
| 21 | (8) 50 | (15) 30 | 102 | 0.68 | 0.05 | 102 | 0.68 | 0.05 | Sample of the present invention |

TABLE 2-continued

| Sample No. | Compound comprising an element of group VIII and its amount | Black-and-white developing agent and its amount | Development with solution (C) Sensitivity | Gamma | Fog | Development with solution (D) Sensitivity | Gamma | Fog | Remarks |
|---|---|---|---|---|---|---|---|---|---|
| 22 | (8) 90 | (15) 30 | 100 | 0.69 | 0.04 | 100 | 0.69 | 0.04 | " |
| 23 | (8) 50 | — | 95 | 0.66 | 0.05 | 95 | 0.77 | 0.06 | Comparative sample |
| 24 | (8) 50 | (26) 1.0 | 96 | 0.65 | 0.05 | 97 | 0.77 | 0.05 | " |
| 25 | (8) 50 | (26) 40 | 106 | 0.68 | 0.05 | 106 | 0.68 | 0.05 | Sample of the present invention |
| 26 | (8) 50 | (26) 150 | 108 | 0.73 | 0.06 | 110 | 0.84 | 0.06 | Comparative sample |
| 27 | (11) 60 | (29) 90 | 98 | 0.65 | 0.05 | 98 | 0.65 | 0.05 | Sample of the present invention |

N.B.
1. The amounts of the agents added are indicated in milligrams per 100 g of silver.
2. The agents are keyed to the compound numbers listed in the specification.

As Table 2 shows, the samples according to the present invention were subject to much less variation in photographic characteristics than the comparative samples in spite of varying processing conditions, and the former had better gradation characteristics.

EXAMPLE 3

Photographic samples were prepared as in Example 2 except that the silver iodobromide emulsion was sensitized orthochromatically and 1-(2,4,6-trichlorophenyl)-3-3-(2,4-di-t-aminophenoxyacetamido)benzamido]-5-pyrazolone was used as a coupler. The samples were then exposed to a green light and subsequently processed as in Example 2. The characteristic curves of the magenta images formed on the respective samples were analyzed to determine their sensitivities, gamma values and fog densities. The results were the same as those obtained in Example 2 in that the samples according to the present invention were subject to minimum variation in photographic characteristics and retained good gradation characteristics in spite of varying processing conditions.

EXAMPLE 4

Photographic samples were prepared as in Example 2 except that the silver iodobromide emulsion was subjected to panchromatic sensitization and 1-hydroxy-N-[γ-(2,4-di-t-amylphenoxypropyl)]-2-naphthoamide was used as a coupler. The samples were then exposed to a red light and subsequently processed as in Example 2. The characteristic curves of the cyan images formed on the respective samples were analyzed to determine their sensitivies, gamma values and fog densities. The results were the same as those obtained in Example 2 in that the samples according to the present invention were subject to minimum variation in photographic characteristics and retained good gradation characteristics in spite of varying processing conditions.

The same procedure was repeated but this time the development with solution (C) following exposure to a red light was effected at 38.3° C., not at 37.8° C. as in Example 2. Analysis of the characteristic curves of the resulting cyan images showed that the samples according to the present invention were subject to minimum variation in photographic characteristics and retained good gradation characteristics in spite of varying processing conditions.

EXAMPLE 5

A low-sensitivity silver iodobromide emulsion containing 4 mol % of silver iodide prepared by the double-jet method was subjected to gold and sulfur sensitizations and divided into 9 poritons. To the respective portions (each weighing 1 kg and containing 1 mol of silver halide), compounds comprising an element of group VIII and/or black-and-white developing agents were added as aqueous solutions in the amounts indicated in Table 3 below.

One hundred and sixty grams of α-(4-carboxyphenoxy)-α-pivaloyl-2-chloro-5-[α-(3-pentadecylphenoxy)-butylamido] acetanilide was completely dissolved in a mixture of tricresyl phosphate (100 ml) and ethyl acetate (50 ml), and 2 g of sorbitan monolaurate was added to the solution. The resulting solution was added to 1 kg of a 10 wt % aqueous gelatin solution containing 2.5 g of dodecylbenzenesulfonic acid, and the mixture was stirred at high speed and then stirred by ultrasonic waves to prepare an emulsion. The emulsion (400 g) was added to each of the previously prepared emulsions together with a hardener and a spreader. The resulting emulsions were applied onto cellulose triacetate bases and dried. High-sensitivity photographic emulsions containing compounds of an element of group VIII, black-and-white developing agents and emulsions as in Example 2 (see Tables 3 and 2) were applied onto the low-sensitivity emulsion layers. The resulting photographic samples were subjected to photographic processing as in Example 2. The characteristic curves of the yellow images formed on the respective samples were analyzed to determine their sensitivites, gamma values and fog densities. The sensitivities were indicated as in Example 1. The results are shown in Table 3.

TABLE 3

| Sample No. | High-sensitivity layer (indicated by sample No. used in Ex. 2) | Compound in low-sensitivity layer and its amount | Development with solution (C) Sensitivity | Gamma | Fog | Development with solution (D) Sensitivity | Gamma | Fog | Remarks |
|---|---|---|---|---|---|---|---|---|---|
| 28 | 16 | — | 100 | 0.75 | 0.07 | 112 | 1.01 | 0.09 | Control |
| 29 | 16 | (8) 50 | 97 | 0.64 | 0.06 | 97 | 0.86 | 0.08 | " |
| 30 | 16 | (15) 30 | 107 | 0.82 | 0.07 | 120 | 0.90 | 0.08 | " |
| 31 | 16 | (8) 50 + (15) 30 | 107 | 0.70 | 0.06 | 107 | 0.70 | 0.06 | Sample of the present invention |
| 32 | 19 | (8) 50 | 110 | 0.80 | 0.07 | 110 | 0.81 | 0.07 | " |
| 33 | 23 | (15) 30 | 97 | 0.67 | 0.06 | 97 | 0.67 | 0.06 | " |
| 34 | 21 | (8) 50 | 100 | 0.66 | 0.05 | 100 | 0.66 | 0.05 | " |
| 35 | 21 | (26) 30 | 105 | 0.69 | 0.06 | 105 | 0.69 | 0.06 | " |

TABLE 3-continued

| Sample No. | High-sensitivity layer (indicated by sample No. used in Ex. 2) | Compound in low-sensitivity layer and its amount | Development with solution (C) | | | Development with solution (D) | | | Remarks |
|---|---|---|---|---|---|---|---|---|---|
| | | | Sensitivity | Gamma | Fog | Sensitivity | Gamma | Fog | |
| 36 | 21 | (26) 100 | 109 | 0.71 | 0.06 | 115 | 0.94 | 0.06 | Comparative sample |

N.B.
1. The amounts of the compounds in the low-sensitivity layers are indicated in milligrams per 100 g of silver.
2. Each high-sensitivity layer was coated with an emulsion corresponding to that of sample No. used in Ex. 2.
3. The compounds in the low-sensitivity layers are keyed to the compound numbers listed in the specification.

As Table 3 shows, the samples of the present invention were subject to much less variation in photographic characteristics than the comparative samples in spite of varying processing conditions, and the former had better gradation characteristics.

EXAMPLE 6

The control sample prepared in Example 4 was coated with the control emulsion used in Example 3 and further provided yellow filter layer. Samples having this layer arrangement were coated with the 12 emulsions used in Example 2. The so prepared samples were exposed to a white light and subsequently processed as in Example 2. The characteristic curves of the cyan, magenta and yellow images formed on the respective samples were analyzed for determining their sensitivities, gamma values and fog densities. The results were the same as in Example 2 for images of each color, demonstrating that the samples of the present invention were subject to minimum change in photographic characteristics and retained good gradation characteristics in spite of varying processing conditions.

What is claimed is:

1. A silver halide photographic material containing 40–500 mg. per 100 g of silver, of a water-soluble compound comprising a metal selected from ruthenium, rhodium, palladium, osmium, iridium, and platinum and having a molecular weight of at least 100; and 1.2 to 120 mg of a black-and-white silver halide developing agent per 100 g of silver.

2. A silver halide photographic material according to claim 1, wherein the cation of said salt of metal is an ammonium ion or an alkaline metal or alkaline earth metal ion.

3. A silver halide photographic material according to claim 1, wherein the ligand of said salt of metal is selected from among a hydroxy group, a cyano, $H_2O$, a halogen atom, a nitro, $SO_3$, ammonia and $C_2O_4$.

4. A silver halide photographic material according to claim 1, wherein said salt of metal is a salt of rhodium, iridium or platinum.

5. A silver halide photographic material according to claim 1, wherein said water-soluble compound is added in the photographic material in an amount of 40 mg to 500 mg per 100 g of silver.

6. A silver halide photographic material according to claim 1, wherein said water-soluble compound is contained in the silver halide emulsion layer of the photographic material.

7. A silver halide photographic material according to claim 1, wherein said developing agent is a 3-pyrazolidone compound or a hydroxybenzene compound.

8. A silver halide photographic material according to claim 7, wherein said 3-pyrazolidone compound is selected from among 1-phenyl-3-pyrazolidone, 1-p-tolyl-3-pyrazolidone, 5-phenyl-3-pyrazolidone, 5-methyl-3-pyrazolidone, 1-phenyl-5-methyl-3-pyrazolidone, 1-acetamidophenyl-3-pyrazolidone, 1-phenyl-4,4-dimethyl-3-pyrazolidone, 1-p-tolyl-4,4-dimethyl-3-pyrazolidone, 1-phenyl-4-methyl-3-pyrazolidone, 4-hydroxy-4-methyl-1-phenyl-3-pyrazolidone and 4-hydroxymethyl-4-methyl-1-phenyl-3-pyrazolidone.

9. A silver halide photographic material accoring to claim 7, wherein said hydroxybenzene compound is selected from among hydroquinone, catechol, pyrogallol, N-methyl-p-aminophenol, p-$\beta$-hydroxyethylaminophenol, p-$\alpha$-aminoethylaminophenol and N-methyl-N-($\mu$-sulfoamidoethyl) -p-aminophenol.

10. A silver halide photographic material according claim 1, wherein said developing agent is contained in the photographic material in an amount of 11 mg to 110 mg per 100 g of silver.

11. A silver halide photographic material according to claim 1, wherein said developing agent is incorporated in the silver halide emulsion layer of the photographic material.

12. A silver halide photographic material according to claim 1, wherein said water-soluble compound and said developing agent are incorporated in the same layer of the photographic material.

* * * * *